US008752731B2

(12) United States Patent
Nimmo et al.

(10) Patent No.: US 8,752,731 B2
(45) Date of Patent: Jun. 17, 2014

(54) METHOD FOR PRODUCING A DEVICE FOR DISPENSING FLUID PRODUCT UNDER PRESSURE, APPARATUS FOR IMPLEMENTING SUCH A METHOD AND DEVICE FOR DISPENSING FLUID PRODUCT UNDER PRESSURE

(75) Inventors: Chris Nimmo, Amersham (GB); Olivier Bertaud, Boulogne (FR)

(73) Assignee: Power Container Corp., Somerset, NJ (US)

( * ) Notice: Subject to any disclaimer, the term of this patent is extended or adjusted under 35 U.S.C. 154(b) by 994 days.

(21) Appl. No.: 12/673,354

(22) PCT Filed: Aug. 13, 2008

(86) PCT No.: PCT/EP2008/060645

§ 371 (c)(1),
(2), (4) Date: Jan. 25, 2011

(87) PCT Pub. No.: WO2009/021976

PCT Pub. Date: Feb. 19, 2009

(65) Prior Publication Data

US 2011/0108574 A1 May 12, 2011

Related U.S. Application Data

(60) Provisional application No. 60/955,748, filed on Aug. 14, 2007, provisional application No. 60/975,954, filed on Sep. 28, 2007.

(30) Foreign Application Priority Data

Aug. 14, 2007 (FR) ..... 07/05855
Sep. 28, 2007 (FR) ..... 07/06850

(51) Int. Cl.
*G01F 11/00* (2006.01)

(52) U.S. Cl.
USPC ..... 222/1; 222/94; 222/95; 222/105; 222/386.5; 222/402.1; 141/2; 141/3

(58) Field of Classification Search
USPC ..... 222/1, 94–95, 105, 386.5, 402.1, 222/402.23, 402.16; 141/3, 20, 2; 29/700
See application file for complete search history.

(56) References Cited

U.S. PATENT DOCUMENTS 4,387,833 A * 6/1983 Venus, Jr. ..... 222/95
4,423,829 A * 1/1984 Katz ..... 222/95

(Continued)

FOREIGN PATENT DOCUMENTS

CA 1337812 12/1995
EP 0391817 10/1990

(Continued)

OTHER PUBLICATIONS

International Search Report issued for FR 0705855 dated Oct. 22, 2009.

(Continued)

*Primary Examiner* — Frederick C Nicolas
(74) *Attorney, Agent, or Firm* — McDonnell Boehnen Hulbert & Berghoff LLP

(57) ABSTRACT

Disclosed is a method for producing a dispensing device (1). The method includes mounting a valve (4) into a dispensing opening (7) of an internal reservoir (3) with a variable volume, sealingly attaching an attachment sleeve (22) made of thermoplastic polymer to the internal reservoir (3), disposing the internal reservoir (3) and the valve (4) inside an external container (5) made of thermoplastic polymer, placing the attachment sleeve (22) opposite to and at a distance from a mounting opening (16) of the external container (5), inserting through the mounting opening (16) a pressurized gas between the internal reservoir (3) and the external container (5), and closing off the mounting opening (16) with the attachment sleeve (22) and welding the attachment sleeve (22) and the external container (5) to one another.

25 Claims, 6 Drawing Sheets

(56) References Cited

U.S. PATENT DOCUMENTS

| | | | | |
|---|---|---|---|---|
| 4,969,577 | A | 11/1990 | Werding | |
| 5,111,971 | A | 5/1992 | Winer et al. | |
| 5,139,168 | A * | 8/1992 | Gueret | 222/92 |
| 5,979,707 | A * | 11/1999 | Bodin et al. | 222/95 |
| 6,019,252 | A * | 2/2000 | Benecke et al. | 222/95 |
| 6,662,941 | B2 * | 12/2003 | Lowry et al. | 206/204 |
| 2004/0004088 | A1 | 1/2004 | Yerby et al. | |
| 2005/0155980 | A1 * | 7/2005 | Neuhalfen | 222/95 |
| 2008/0272145 | A1 | 11/2008 | Nimmo et al. | |
| 2009/0045222 | A1 * | 2/2009 | Nimmo et al. | 222/95 |

FOREIGN PATENT DOCUMENTS

| | | |
|---|---|---|
| GB | 1024556 | 3/1966 |
| WO | 01/89956 | 11/2001 |
| WO | 2006/087462 | 8/2006 |

OTHER PUBLICATIONS

Partial International Search Report issued for FA 699602 and FR 0706850 dated May 29, 2008.

* cited by examiner

METHOD FOR PRODUCING A DEVICE FOR DISPENSING FLUID PRODUCT UNDER PRESSURE, APPARATUS FOR IMPLEMENTING SUCH A METHOD AND DEVICE FOR DISPENSING FLUID PRODUCT UNDER PRESSURE

FIELD OF THE INVENTION

The invention relates to a method for producing a device for dispensing fluid product under pressure, to an apparatus for implementing such a method and to a device for dispensing fluid product under pressure.

In particular, the invention applies to a device for dispensing pressurized fluid product, comprising:

- an internal reservoir with a variable volume and suitable for containing a fluid product to be dispensed, said internal reservoir comprising a deformable side wall and a dispensing opening,
- a valve provided with an actuation member, mounted in the dispensing opening and suitable for dispensing the pressurized fluid product to the outside,
- a rigid external container of generally cylindrical shape along an axis and comprising a first closed end and a second end having a mounting opening, the internal reservoir and the valve being placed inside the external container along the axis, the actuation member protruding toward the outside relative to the mounting opening, the internal reservoir and the external container delimiting between them an internal volume in which a pressurized gas is placed,
- an attachment sleeve sealingly attached to the internal reservoir, said attachment sleeve sealingly closing off the mounting opening and being attached at the second end of the external container.

DESCRIPTION OF THE RELATED ART

In a known dispensing device of this type, the attachment sleeve is attached to the container by crimping. To ensure the gas seal of the internal volume, an elastomer seal is interposed between the attachment sleeve and the external container at the crimping.

However, the method for producing such a dispensing device is difficult to implement.

Actually, the method for producing comprises in particular a step of crimping which requires preliminary steps of shaping and of positioning of the attachment sleeve and of the second end of the external container to withstand the forces applied during the crimping and to provide a satisfactory attachment. In addition, a step of accurately installing the seal is necessary to achieve the airtightness. Actually, in the event of incorrect positioning, there is, at the step of crimping, a risk of damaging the seal making the dispensing device unusable.

SUMMARY OF THE INVENTION

The object of the invention is to solve the problems mentioned above.

Accordingly, the invention proposes a method for producing a device for dispensing a fluid product under pressure, the device for dispensing a fluid product under pressure being of the aforementioned type and comprising the external container and the attachment sleeve made of thermoplastic polymer, said method comprising the following steps:

- mounting the valve into the dispensing opening of the internal reservoir,

- sealingly attaching the attachment sleeve to the internal reservoir,
- disposing the internal reservoir and the valve inside the external container through the mounting opening,
- placing the attachment sleeve opposite to and at a distance from the second end of the external container,
- inserting through the mounting opening a pressurized gas into the internal volume,
- closing off the mounting opening with the attachment sleeve, and welding the attachment sleeve and the external container to one another.

Therefore, the attachment sleeve and the external container may be shaped by applying simple steps, particularly of injection molding or of blow molding. Furthermore, the attachment of the attachment sleeve to the external container and the gastightness of the internal volume are achieved simply and in a single operation, the thermoplastic polymer that has fused during welding performing the attachment and sealing functions.

Besides, the welding between the attachment sleeve and the external container, both made of thermoplastic polymer, improves tightness and attachment in a dispensing device pressurized prior to the sealing in a tight and hermetic manner of the internal volume. The welding, and thus the tightness and the attachment, can be more adapted to withstand the gaz pressure within the internal volume. Security of the dispensing device is thus enhanced.

The method also permits to produce a dispensing device without filling opening accessible after the device has been assembled. The method permits, in particular, to produce a dispensing device wherein the mounting opening is the single opening of the external container, and the attachment sleeve comprises a single central orifice for the valve. Producing the dispensing device is thus simplified and security of the dispensing device is enhanced, the risks of gas leaking and of access to the internal volume by a user being prevented.

In embodiments, the production method may comprise one or more of the following arrangements:

- in the production method:
  - before the attaching step, on the one hand, the external container whose second end forms a neck which delimits the mounting opening, and, on the other hand, the attachment sleeve comprising a side wall suitable for being sleeve-fitted into the neck are produced, the side wall and the neck comprising respectively two radial thickenings comprising respectively two end zones suitable for interfering with one another during the closing-off and welding step, at least one of the end zones having a frustoconical terminal surface flaring outward,
  - during the closing-off and welding step, the side wall is sleeve-fitted into the neck and the end zones are fused together,
- in the method:
  - during the production of the external container and of the attachment sleeve, it is produced:
    - on the neck, an annular rim which extends radially outward and which has a first contact surface,
    - on the attachment sleeve, an annular collar having a second contact surface suitable for being in contact with the first contact surface,
    - a recess on at least one of the first and second contact surfaces,
  - during the closing-off and welding step, at least a portion of the fused thermoplastic polymer of the end zones is moved into the recess, in the method, after the disposing step, the attachment sleeve is positioned on the second end of the external container, and during the placing step, the attachment sleeve is lifted, in the method, to lift the attachment sleeve, the attachment sleeve is sucked into a seat in which the vacuum is generated, in the method, during the attaching step, the internal reservoir and the attachment sleeve are welded to one another, in the method:

before the attaching step, on the one hand, the attachment sleeve comprising an annular base which extends perpendicularly to axis and which has a first welding surface, and, on the other hand, the internal reservoir comprising a ring which extends in the vicinity of the dispensing opening, perpendicularly to an axis, and which has a second welding surface are produced in thermoplastic polymer, at least one of the first and second welding surfaces comprising a protruding annular retaining ring, during the attaching step, during the attachment step, the base and the rings are positioned coaxially, the retaining ring protruding relative to one of the first and second welding surfaces being in contact with the other welding surface, and the retaining ring and said welding surface are fused, in the method, during the closing-off and welding step, an axial load is applied and a friction generated between the attachment sleeve and the external container, in the method, the friction is generated by ultrasound vibrations applied to the attachment sleeve, the production method also comprises, after the closing-off and welding step, a step of installing the actuation member on the valve, the production method also comprises, after the closing-off and welding step, a step of filling the internal reservoir with fluid product.

The invention also proposes an apparatus for implementing the production method as defined above, comprising:

a pressurized gas filling device, a filling chamber closed in a sealed manner and connected to the filling device, said chamber being suitable for receiving at least the second end of the external container and the attachment sleeve positioned on said second end, a release system mounted in the filling chamber and suitable for moving the external container and the attachment sleeve relative to one another and releasing the mounting opening, a welding device placed at least partly in the filling chamber and suitable for welding the external container and the attachment sleeve to one another.

In embodiments, the apparatus may comprise one or more of the following arrangements:

the welding device is suitable for applying an axial load to the attachment sleeve and generating a friction between the attachment sleeve and the external container, the welding device is suitable for generating the friction by applying ultrasound vibrations to the attachment sleeve, the welding device comprises an ultrasound vibration generator and a welding arm which extends along the axis of the external container, the welding arm comprises a first end connected to the generator and a second end which extends in the filling chamber and which is in contact with the attachment sleeve, the generator and the welding arm being able to be moved in translation along the axis of the external container relative to the filling chamber, the release system comprises a fastening device of the external container, a suction device, a duct connected to the suction device and emerging into a seat formed on the second end of the welding arm and suitable for housing at least a portion of the attachment sleeve.

According to another aspect, the subject of the invention is a device for dispensing pressurized fluid product, comprising:

an internal reservoir with a variable volume and suitable for containing a fluid product to be dispensed, said internal reservoir comprising a deformable side wall and a dispensing opening, a valve comprising a body mounted in the dispensing opening, a stem slidingly mounted in the body between a rest position and an actuation position, and an actuation member mounted on the stem, said valve being suitable for dispensing the pressurized fluid product to the outside when the stem is in the actuation position, a external container, made of thermoplastic polymer, rigid, of generally cylindrical shape along an axis and comprising a first closed end and a second end having a single mounting opening, the internal reservoir and the valve being placed inside the external container along the axis, the actuation member protruding toward the outside relative to the mounting opening, the internal reservoir and the external container delimiting between them an internal volume in which a pressurized gas is placed, an attachment sleeve made of thermoplastic polymer, sealingly attached to the internal reservoir, said attachment sleeve sealingly closing off the mounting opening and being welded at the second end of the external container, said attachment sleeve comprising a single central orifice traversed by the stem.

As stated above, the attachment sleeve and the external container, both made of thermoplastic polymer, welded to one another permit to improve tightness, attachment and security in a dispensing device pressurized prior to the sealing in a tight and hermetic manner of the internal volume. And the dispensing device without filling opening offers a simplified producing and an enhanced security.

In addition, the attachment sleeve and the external container are made of materials that are recyclable and of similar kind, which improves the recycling of the dispensing device.

In embodiments, the dispensing device may comprise one or more of the following arrangements:

the second end of the external container forms a neck which delimits the mounting opening and the attachment sleeve comprises a side wall that is sleeve-fitted into the neck, the side wall and the neck are welded to one another along an axial welding zone, the neck comprises an annular rim which extends radially outward, the attachment sleeve comprising an annular collar in contact with the rim along a radial contact zone, a recess receiving at least one portion of the thermoplastic polymer of the welding zone being made in said contact zone, the internal reservoir is at least partly made of thermoplastic polymer, the internal reservoir and the attachment sleeve being welded to one another, the attachment sleeve comprises an annular base which extends radially inside the external container, the internal reservoir comprising a ring which extends radially in the vicinity of the dispensing opening, the base and the ring being welded to one another along a radial welding zone, the first end of the external container is of spherical shape, the dispensing device also comprising a plinth which is associated with the external container and which defines a flat bearing surface, the thermoplastic polymer is chosen from polyethylene terephthalate and polyethylene naphthalate, the thermoplastic polymer is transparent, the dispensing device comprises a fluid product placed in the internal reservoir.

BRIEF DESCRIPTION OF THE DRAWINGS

Other objects and advantages of the invention will appear on reading the following description, made with reference to the appended drawings in which.

In the figures, the same reference numbers indicate identical or similar elements.

DETAILED DESCRIPTION OF THE INVENTION

Figure 1:
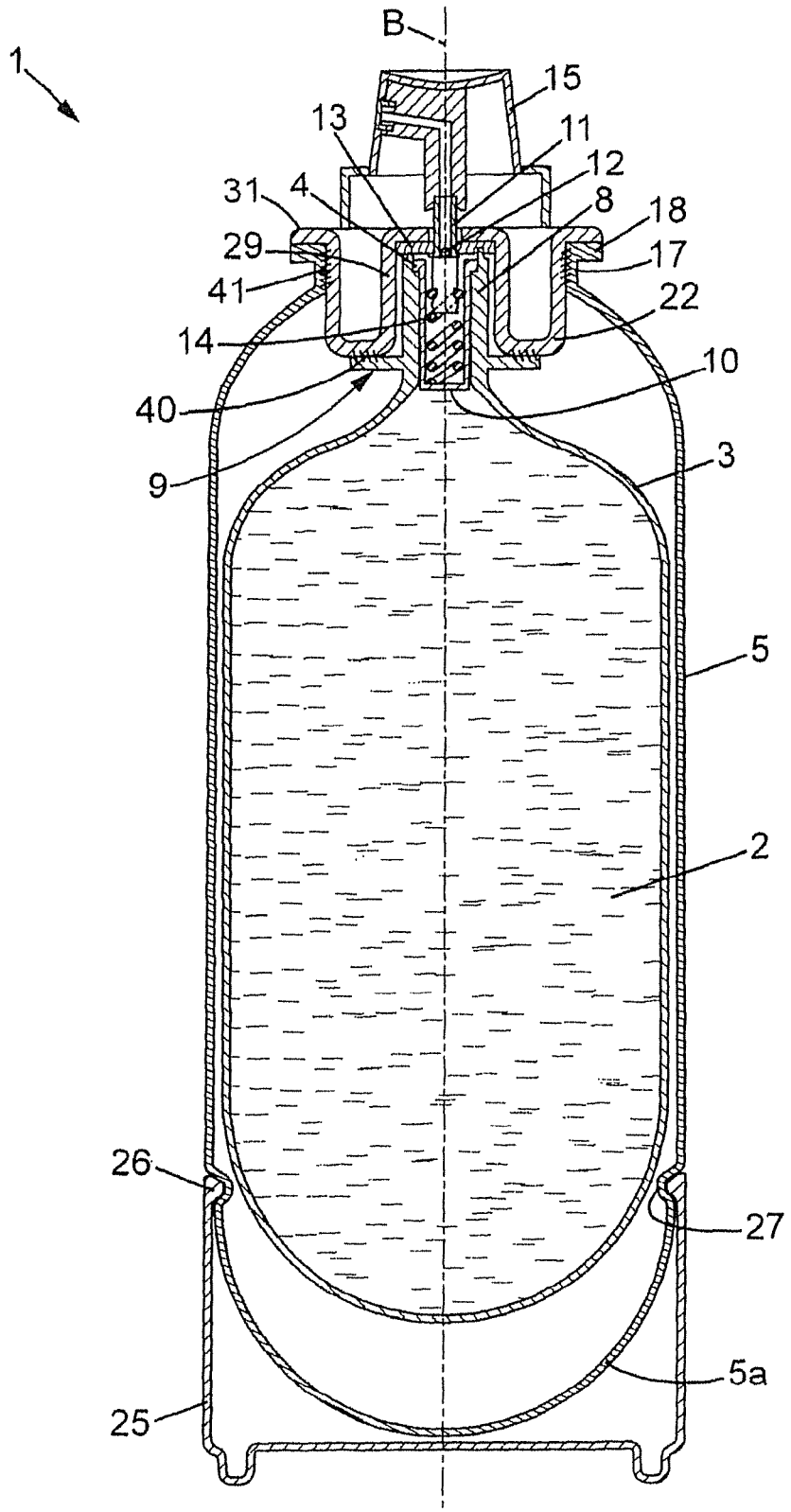
FIG. 1 is a representation in longitudinal section of a dispensing device according to an embodiment of the invention.

FIG. 1 represents a device 1 suitable for the dispensing, particularly the spraying, of a pressurized fluid product such as a liquid 2 containing cleaning or disinfectant agents or a liquid 2 of the pharmacy, cosmetics or perfumery field.

In the embodiment shown, the dispensing device 1 comprises:

a internal reservoir 3 with a variable volume containing the liquid 2 to be dispensed, a valve 4 suitable for dispensing the pressurized liquid 2 to the outside, an external container 5 in which the internal reservoir 3 and the valve 4 are placed and a sleeve 22 for attaching the internal reservoir 3 to the external container 5.

Figure 2:
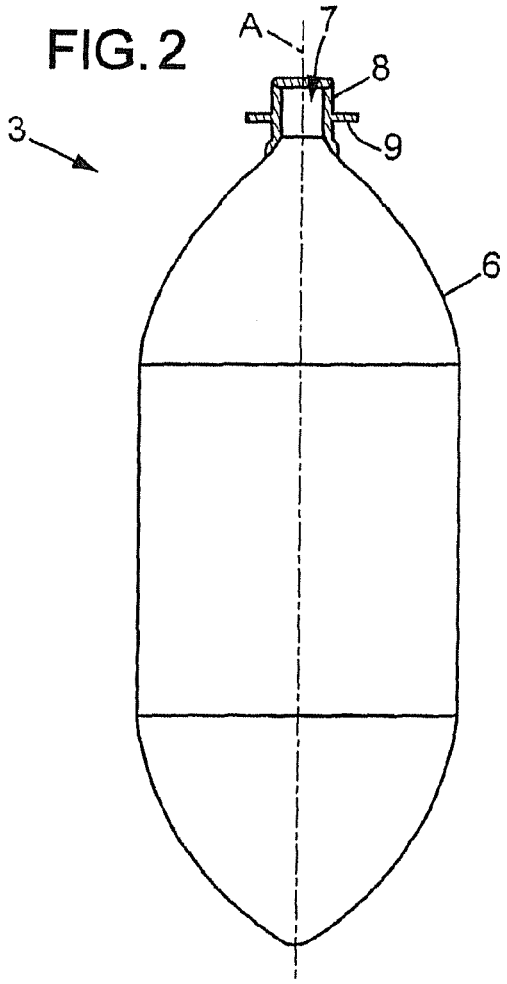
FIG. 2 is a representation in longitudinal section of the internal reservoir, in an extended state, of the dispensing device of FIG. 1.
Figure 3:
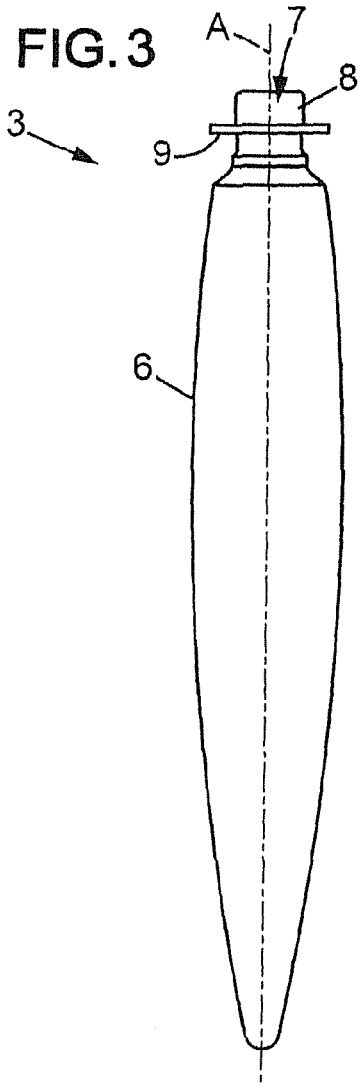
FIG. 3 is a flat representation in side view of the internal reservoir, in a retracted state, of the dispensing device of FIG. 1.

In FIGS. 2 and 3, the internal reservoir 3 is of generally cylindrical shape along an axis A. The internal reservoir 3 comprises a deformable side wall 6 and, at an end, a tubular extension 8 about the axis A. The extension 8 delimits a dispensing opening 7 and has an external surface from which a ring 9 extends radially outward.

Provision is made for at least the extension 8, and in the present embodiment the whole internal reservoir 3, to be able to be made of thermoplastic polymer, that is to say a plastic which can, in a repeated manner, soften under the action of heat and harden while cooling. As an example, the thermoplastic polymers that can be used are polyethylene terephthalate (PET) or polyethylene naphthalate (PEN). The thermoplastic polymer may, advantageously, be transparent.

The internal reservoir 3 is made so as to be able to deform between an extended state, represented in FIGS. 1 and 2, when it is full of liquid 2, and a retracted state, represented in FIG. 3, when it is empty. An exemplary embodiment of the internal reservoir 3 having longitudinal folds or ribs is described in document FR-2 893 315.

As shown in FIG. 1, the valve 4 comprises:

a hollow body 10 mounted in the dispensing opening 7 along the axis A and having first and second open ends, a hollow stem 11 mounted so as to slide in the body 10 between a rest position and an actuation position, the stem 11 having an inlet orifice 12 in communication with the inside of the body when the stem 11 is in the actuation position, a valve element for closing off the inlet orifice, formed by a seal 13, the seal 13 closing the inlet orifice 12 in the rest position of the stem 11, a return member, such as a spring 14, forcing the stem 11 to the rest position.

As can be seen in FIG. 1, an actuation member in the form of a pushbutton 15 is sleeve-fitted onto the stem 11 in order to be able to move it from the rest position to the actuation position.

Figure 4:
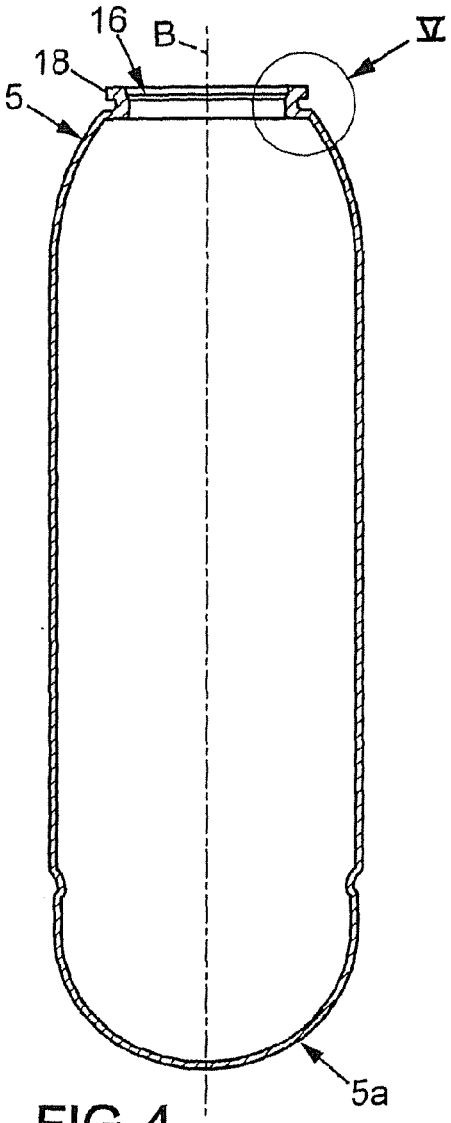
FIG. 4 is a representation in longitudinal section of an external container of the dispensing device of FIG. 1.

In FIG. 4, the external container 5 has a generally cylindrical shape along an axis B and comprises a first closed end, forming a bottom 5*a*, and a second end having a mounting opening 16. In the represented embodiment, the mounting opening is the sole opening of the external container 5. The external container 5 is then deprived of any other opening, such as a filling hole for the gas under pressure, the filling being made, as explained later, through the mounting opening 16 by the assembling of the dispensing device.

Figure 5:
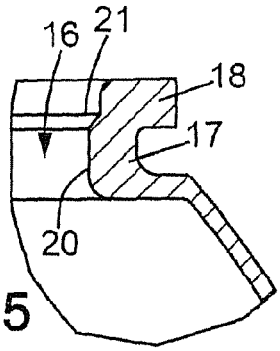
FIG. 5 is an enlarged representation of the detail referenced V in FIG. 4.

In FIG. 5, the second end of the external container forms a neck 17 which delimits the mounting opening 16. The neck 17 comprises an annular rim 18 which extends radially outward relative to the axis B. The neck 17 has, furthermore, internally a radial thickening 20 relative to the axis B. The thickening is offset axially toward the bottom 5*a* of the external container 5 and comprises an extreme zone opposite to the bottom 5*a*. The extreme zone has a frustoconical terminal surface 21 flaring outward.

As shown in FIG. 1, the internal reservoir 3 and the valve 4 are placed in the external container 5 so that the axis A of the internal reservoir 3 and the axis B of the external container 5 are coaxial, the pushbutton 15 protruding outward relative to the mounting opening 16. The external container 5 and the internal reservoir 3 then delimit between them an internal volume in which a pressurized gas is placed.

The gas may in particular be air, nitrogen, argon, carbon dioxide or another gas. The gas is inserted into the internal volume in any appropriate form, particularly gaseous or dissolved in an appropriate liquid or solid medium, the release of the dissolved gas in the liquid or solid medium making it possible to maintain a constant pressure in the internal volume made between the external container 5 and the internal reservoir 3.

Provision is made for the external container 5 to form a barrier to the gas and to offer a chemical resistance to the gas and a mechanical resistance to a pressure higher than 20 bar.

In particular, the external container 5 is made of thermoplastic polymer, such as PET or PEN, advantageously transparent, used alone or in the form of a mixture, in order to be able to soften under the action of heat and harden when cooling, in order to form a barrier to the gas and to offer the chemical resistance and mechanical resistance to pressure. For example, provision can be made for the external container 5 to be in the form of a rolled element comprising a layer of PET or of PEN, and or else a layer of Nylon, particularly Nylon MXD6, or else a layer of ethylene vinyl alcohol (EVOH) resin or else a layer of silicon oxide. Such an embodiment in the form of a rolled element may also be applied to the internal reservoir 3 in order to form a gas and liquid barrier and offer chemical and mechanical resistances suitable for the use of the dispensing device.

In addition, the shape of the external container 5 may be adapted to resist such a pressure. For example, in FIG. 1, the bottom 5*a* of the external container 5 is of spherical shape, the dispensing device 1 also comprising a plinth 25 which is associated with the external container 5, for example by snap fitting an annular roll 26 of the plinth 25 in an annular groove 27 of the external container 5. The plinth 25 defines a flat bearing surface on which the dispensing device 1 can rest.

Figure 6:
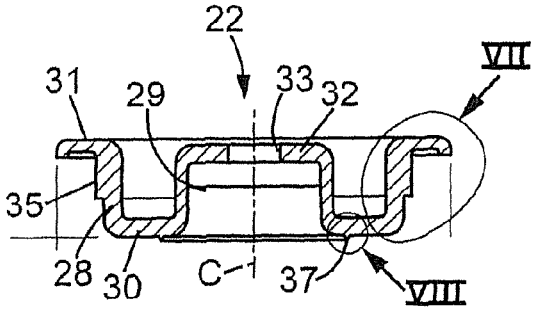
FIG. 6 is a representation in longitudinal section of a sleeve for attaching the internal reservoir to the external container of the dispensing device of FIG. 1.
Figure 7:
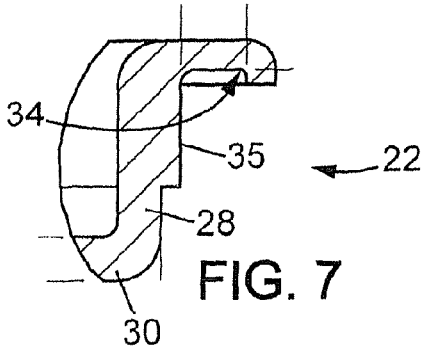
FIG. 7 is an enlarged representation of the detail referenced VII in FIG. 6.
Figure 8:
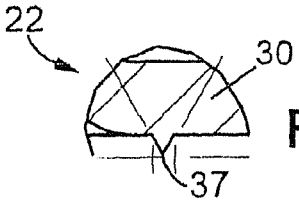
FIG. 8 is an enlarged representation of the detail referenced VIII in FIG. 6.

To attach the internal reservoir 3 to the external container 5, the attachment sleeve 22 shown in FIGS. 6 to 8 is used.

The attachment sleeve 22 is made of thermoplastic polymer, particularly PET or PEN, advantageously transparent. The attachment sleeve 22 comprises a tubular side wall 28 along an axis C, surrounding an annular wall 29 placed coaxially to the axis C and connected to the side wall 28 by an annular base 30 that is radial relative to the axis C. The side wall 28 has a radial dimension that is substantially similar to that of the neck 17 of the external container 5.

As a non limiting example, provision can be made for the radial wall 28 to allow the attachment sleeve 22 to be adapted to an external container 5 of standard dimension. Therefore, the neck 17 and the side wall 28 may have a standard radial dimension, namely a diameter of the order of 25.4 mm. The side wall 28 and the neck 17 may however have any dimensions appropriate to the use of the dispensing device and to the attachment of the attachment sleeve 22 to the external container 5 as explained below.

The attachment sleeve 22 also comprises an annular collar 31 which extends radially outward relative to the axis C from a free end of the side wall 28. A radial plate 32 provided with a central orifice 33 extends from the free end of the internal wall 29. In the represented embodiment, the central orifice 33 is the sole opening of the attachment sleeve 22. Thus, as for the external container 5, the attachment sleeve 22 is deprived of filling hole for the gaz under pressure. The filling of the gas under pressure is explained later.

As shown in FIG. 7, the side wall 29 comprises a thickening 35 which extends radially outward relative to the axis C from the annular collar 31 to an extreme zone placed at a distance from the base 30. The extreme zone of the thickening 35 formed on the side wall 28 has a radial terminal surface and is suitable for interfering with the extreme zone of the thickening 20 of the neck 17. As a variant, this surface could be frustoconical flaring outward. Additionally, in FIG. 7, the annular collar 31 has a bottom contact surface that is oriented toward the base 30 and on which a recess 34 is formed.

In addition, as shown in FIG. 8, the base 30 of the attachment sleeve 22 has an annular retaining ring 37 protruding relative to a surface opposite to the side wall 28.

In the embodiment shown in FIG. 1, the extension 8 of the internal reservoir 3 extends coaxially to the inside of the internal wall 29, the seal 13 being held between the plate 32 of the attachment sleeve 22 and a free end of the extension. The stem 11 traverses the central orifice 33 of the plate 32 so that the body 10 of the valve 4 and the pushbutton are placed on either side of the plate 32. The attachment sleeve 22 is attached in a sealed manner to the internal reservoir 3, by a weld along a radial welding zone 40.

Furthermore, the side wall 28 is sleeve-fitted into the neck 17 so that the attachment sleeve 22 closes off the mounting opening 16. The annular collar 31 is in contact with the rim 18 along a radial contact zone defined by the contact surface of the annular collar 31 and a contact surface formed on the rim 18. The annular base 30 extends radially inside the external container 5. To ensure the sealed attachment of the attachment sleeve 22 to the external container 5, the side wall 28 and the neck 17 are welded to one another along an axial welding zone 41, located within the neck 17 in the represented embodiment.

In the welding zones 40, 41, the thermoplastic polymer softened by heating at the interface between the attachment sleeve 22 and the internal reservoir 3, on the one hand, and the external container 5, on the other hand, fuses and then hardens in order to form continuous annular joins about the axis B of the external container 5. The annular joins then provide both the attachment of the attachment sleeve 22 to the internal reservoir 3 and external container 5 and the gastightness.

Once the attachment sleeve 22 has been secured to the external container 5, the internal volume is sealed in a tight and hermetic manner by the welding zones and the walls of the external container 5 and of the attachment sleeve deprived of opening communicating with the internal volume. The pressurized gas in the internal volume cannot leak to the outside and no other external fluid, especially air, can flow within the internal volume.

In a device as described above, the liquid 2 is dispensed or sprayed under the action of a mechanical stress that is exerted on the internal reservoir 3 by the gas. Such a dispensing device may then operate in all positions.

To spray liquid 2, a user actuates the pushbutton 15 by exerting a pressure to move the stem 11 toward the actuation position and release the inlet orifice 12 of the seal 13 and place it in communication with the inside of the body 10 and of the internal reservoir 3. Under the action of the pressurized gas, the side wall 6 of the internal reservoir 3 deforms to the retracted state and pressurized liquid 2 can be dispensed to the outside, particularly sprayed by means of the appropriate pushbutton 15.

When the user releases the pressure, the hollow stem 11 rises under the effect of the spring 14 to reposition the inlet orifice 12 opposite the seal 13.

A method for producing a dispensing device as described above is now described.

In a prior step, the internal reservoir 3, the external container 5 and the attachment sleeve 22 that have been described above are produced in thermoplastic polymer.

In particular, the attachment sleeve 22 can be produced by injection molding and the internal reservoir 3 and the external container 5 may be produced by a blow molding method, particularly by biaxial stretch blow molding, called the "stretch blow" method.

In the "stretch blow" method, a preform is produced by injection in a first mold. The preform comprises a side wall which extends from a closed end to an open end. The side wall may have a substantially conical, shape flaring toward the open end, with, for example, an angle at the peak that lies between 1° and 5°. The preform is then transferred by indexation into a second mold in which it is axially stretched by means of a stylet inserted through the open end. The stretching is combined with a blow.

As indicated above, provision can be made to produce on the internal reservoir 3 longitudinal folds or ribs, particularly via a method described in document WO-2006/087462.

In a subsequent step of the production method, the body 10 of the valve 4, in which the spring 14 and the stem 11 are placed, is sleeve-fitted into the dispensing opening 7 of the internal reservoir 3.

Then the seal 13 and the extension 8 of the internal reservoir 3 are placed in the internal wall 29 of the attachment sleeve 22, the hollow stem 11 traversing the central orifice 33 of the plate 32, the base 30 and the ring 9 being positioned coaxially.

The production method then comprises a step of attachment during which the protruding retaining ring 37 is placed in contact with a welding surface opposite the ring 9 and the ring 9 is welded to the base 30 by fusing the retaining ring 37 and the welding surface of the ring 9.

In a particular exemplary embodiment, the welding is carried out by generating friction between the base 30 and the ring 9. The base 30 may, for example, be pressed on the ring 9 by applying ultrasound vibrations on the attachment sleeve 22, the internal reservoir 3 being attached to a frame having a bearing surface on which a surface of the ring 9 opposite to the welding surface rests. The ultrasound vibrations generate friction which causes local heating leading to the fusion of the thermoplastic and to the welding of the attachment sleeve 22 to the internal reservoir 3. The annular retaining ring 37 makes it possible to form a linear contact making welding easier.

The description has been made with an annular retaining ring 37 formed on the base 30 of the attachment sleeve 22. In other embodiments, it is however possible to provide one or more protruding retaining rings formed on the ring 9 of the internal reservoir 3 and/or on the base 30.

In the method, after the attaching step described above:

- the internal reservoir 3 in the retracted state and the valve 4 are placed inside the external container 5 through the mounting opening 16, then
- the attachment sleeve 22 is positioned on the second end of the external container 5; in particular, the side wall 28 may be sleeve-fitted into the neck 17 until the terminal surfaces of the end zones of the swellings 20, 35 come into contact.

In the production method, the filling of the internal volume with gaz under pressure is performed prior to the attachment of the attachment sleeve 22 to the external container 5 and to the closing-off of the mounting opening 16. The dispensing device is then pressurized prior to the attachment of the attachment sleeve 22 to the external container 5 and to the tight and hermetic sealing of the internal volume.

The production method then comprises a step consisting in lifting the attachment sleeve 22 in order to place the attachment sleeve 22 opposite to and at a distance from the second end of the external container 5 and thereby clear a passage in the mounting opening 16 to allow the internal volume to be filled with the gas. The lifting of the attachment sleeve 22 may, for example, be achieved by a vacuum suction of the attachment sleeve 22, which will be described below in relation with an apparatus allowing the application of the method for producing the dispensing device.

The gas is inserted under pressure or dissolved in an appropriate medium into the internal volume through the passageway of the mounting opening 16.

The filling pressure may for example lie between 1.5 bar and 3.5 bar, that is to say at a value lower than the final pressure, for example lying between 4 bar and 10 bar, because the latter will be achieved when the internal reservoir 3 filled with liquid 2 will be in the extended state. Specifically, the pressure in the external container 5 will increase during the filling of the internal reservoir 3, by diminution of the internal volume in which it is confined.

The method then comprises a step of closing off the mounting opening 16 with the attachment sleeve 22 and of welding the attachment sleeve 22 and the external container 5.

Figure 9:
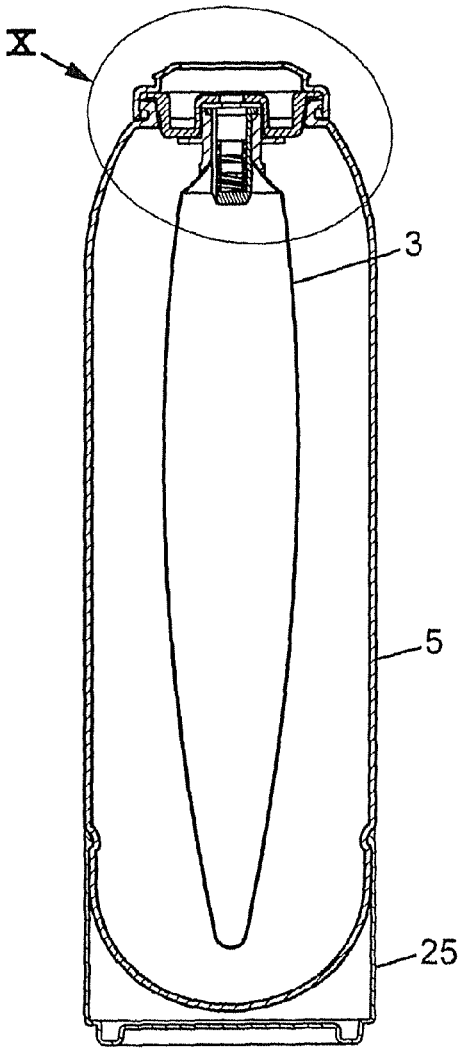
FIG. 9 is a representation in longitudinal section of a step of the production of the dispensing device of FIG. 1.
Figure 10:
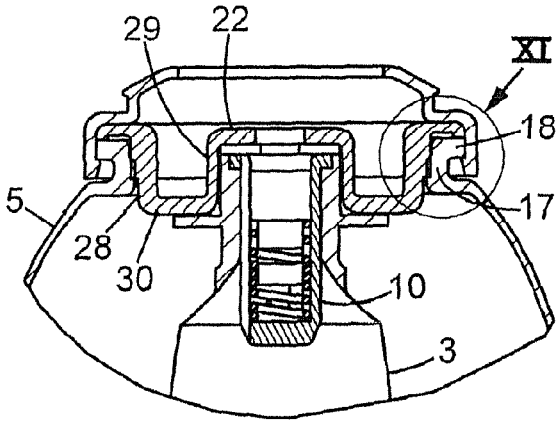
FIG. 10 is an enlarged representation of the detail referenced X in FIG. 9.

During the closing-off and welding step, the neck 17 is held, a bearing surface is placed under the annular rim 18 and the side wall 28 is sleeve-fitted again into the neck 17. An axial load is then applied to the attachment sleeve 22, while generating a friction between the end zones of the thickening 20, 35 of the attachment sleeve 22 and of the external container 5. This produces an assembly as shown in FIGS. 9 and 10.

Figure 11:
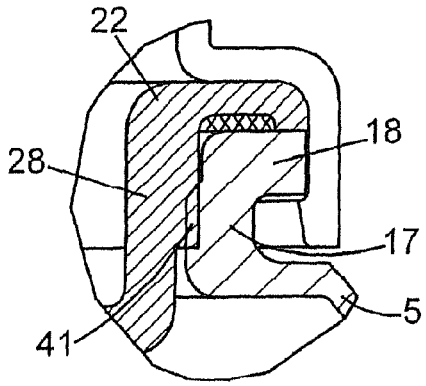
FIG. 11 is an enlarged representation of the detail referenced XI in FIG. 10.

As indicated above, the friction may be generated by ultrasound vibrations applied to the attachment sleeve 22. The end zones of the thickening 20, 35 soften under the effect of the heat given off by the friction and fuse to form the annular join of the axial welding zone 41, as shown in FIG. 11. The passageway for filling pressurized gas is then closed-off in a tight and hermetic manner and the internal volume is sealed.

The frustoconical terminal surface flaring outward makes it possible to simplify the insertion of the side wall 28 into the neck 17 and to help with the heating of the end zones. And as can be seen in FIG. 11, during the insertion of the side wall 28 into the neck, at least a portion of the fused thermoplastic polymer of the end zones may be moved into the recess 34.

The description has been made with a recess 34 arranged on the contact surface of the annular collar 31. It is however possible to provide that one or more recesses are made on the contact surface of the rim 18 and/or the contact surface of the collar 31.

The internal reservoir 3 may then be filled with liquid 2 through the valve 4 whose stem 11 is placed in the actuation position. It is then possible to install the pushbutton 15 on the stem 11 so that the pushbutton 15 protrudes relative to the mounting opening 16.

Figure 12:
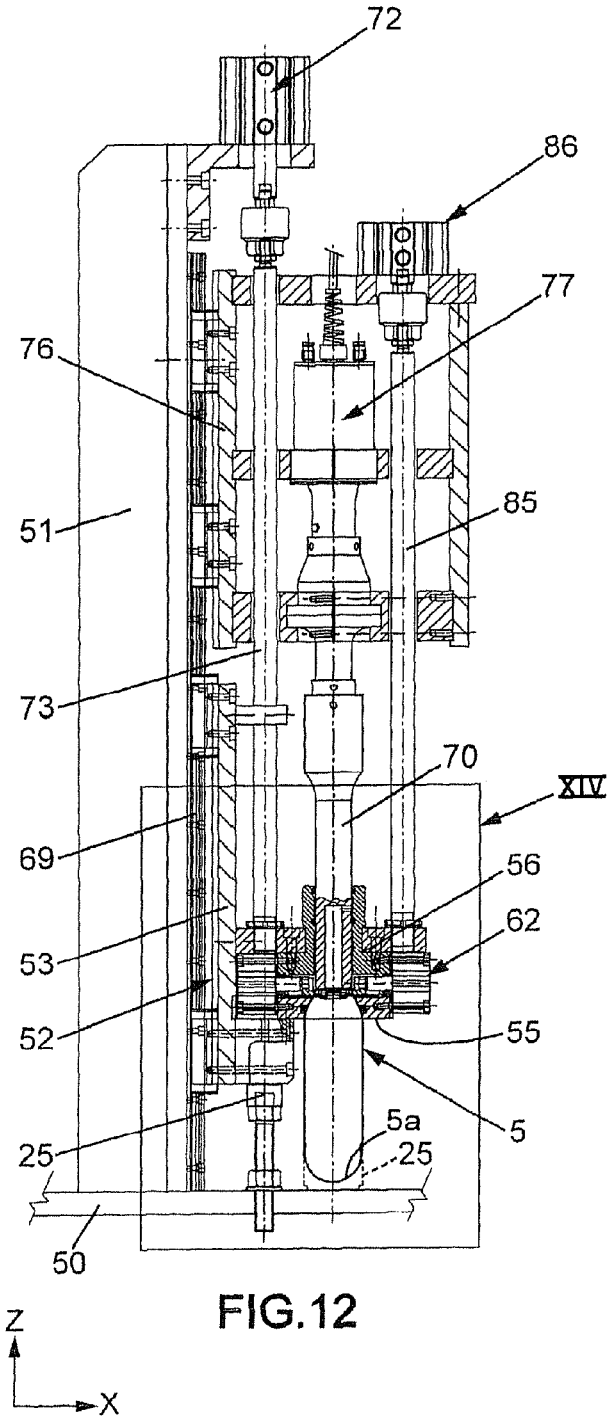
FIG. 12 is a flat representation in side view of an apparatus for applying a method for producing the dispensing device of FIG. 1.
Figure 13:
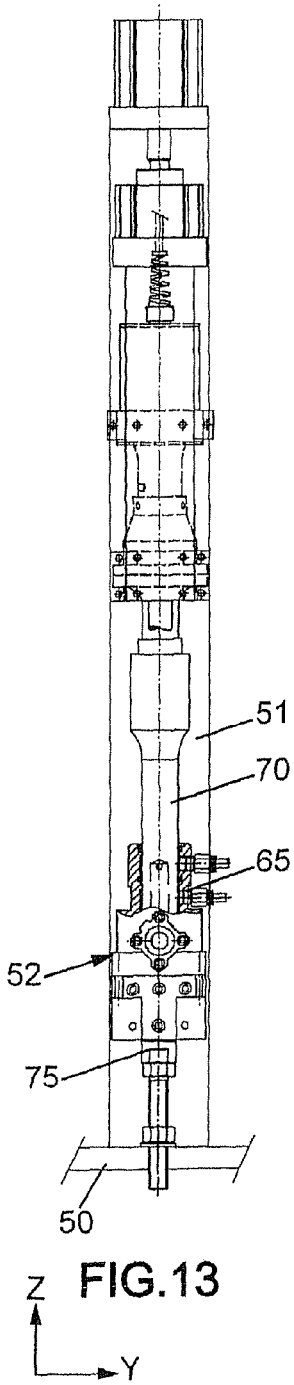
FIG. 13 is a flat representation in front view of the apparatus of FIG. 12.
Figure 14:
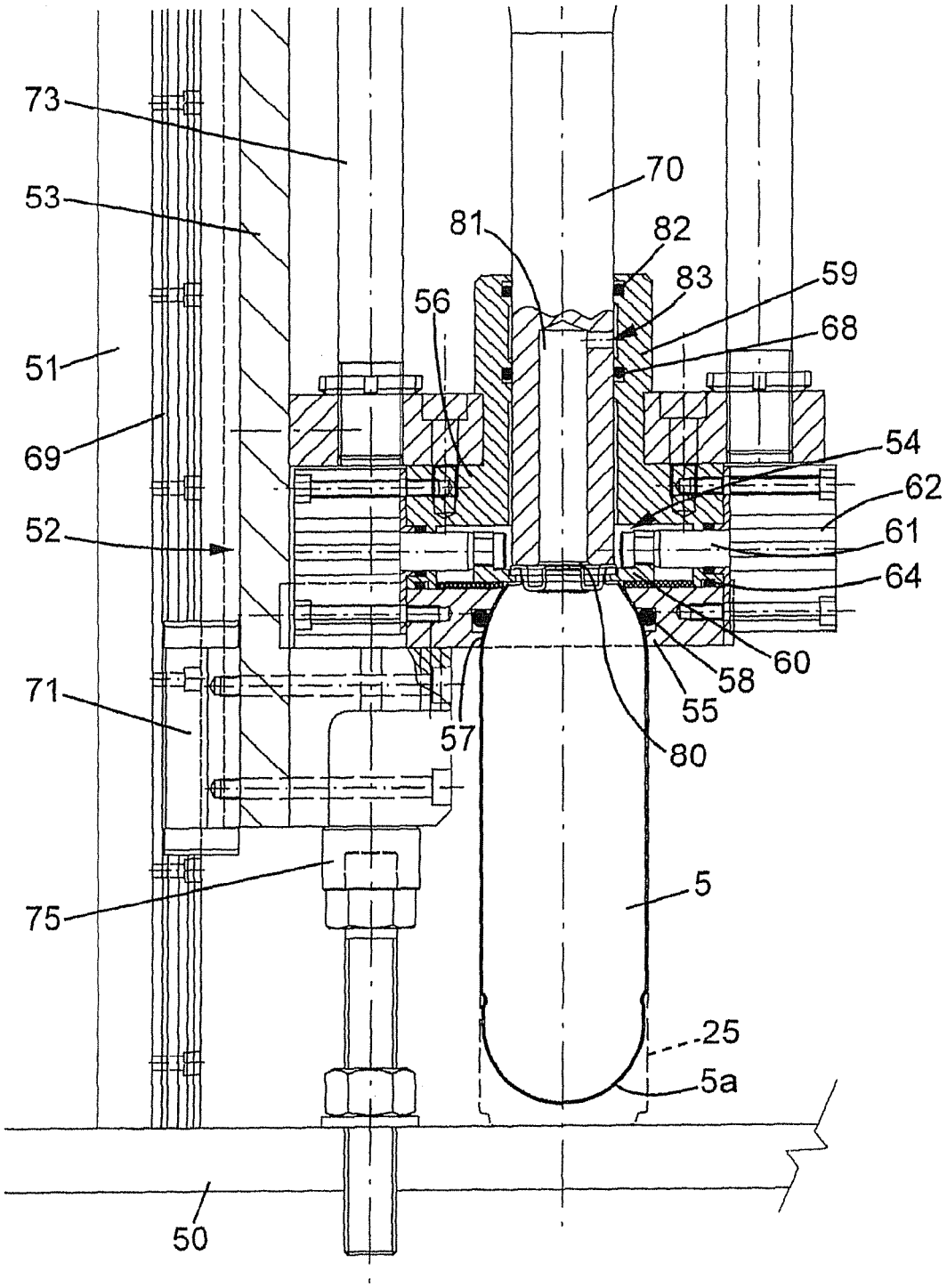
FIG. 14 is an enlarged representation of the detail referenced XIV in FIG. 12.

In relation with FIGS. 12 to 14, an apparatus for applying the production method as described above is now described. More particularly, the apparatus allows the application of the steps described above of lifting the attachment sleeve 22, filling the internal volume with the gas and closing off and welding the attachment sleeve 22 to the container.

In FIG. 12, the apparatus comprises a frame provided with a horizontal foot 50 and a support 51 which extends in a vertical direction Z from the foot 50. Also defined is a horizontal longitudinal direction X and a transverse direction Y that is horizontal and perpendicular to the direction X.

The apparatus also comprises a bottom carriage 52 suitable for holding the external container 5 so that the axis B is vertical.

In particular, the bottom carriage comprises a vertically placed mounting plate 53 to which a filling chamber 54 that is sealed closed is attached. The filling chamber 54 is connected to a device, not shown, for filling with gas, for example in gaseous and pressurized form.

As can be seen in particular in FIG. 14, in the embodiment shown, the filling chamber 54 is suitable for receiving the second end of the external container 5 and the attachment sleeve 22 positioned on said second end. It is however possible to provide, as a variant, for the filling chamber to be able to receive the whole external container 5.

The filling chamber 54 is delimited by a bottom plate 55 which extends horizontally from the mounting plate 53 and a bell 56 which comprises a bottom wall and a side wall. The side wall extends from the bottom wall up to a free end attached to the bottom plate 55, a seal 64 being interposed between the side wall and the plate 55. The bottom wall has a guide opening which extends away from the side wall within a tubular bush 59. The guide opening is closed off in a sealed manner, particularly by means of a seal 68, by a welding arm 70 as explained below.

The bottom plate 55 has a retention opening delimited by an edge 57 formed to receive a portion that is axially offset toward the bottom 5*a* of the external surface of the external container 5. A seal 58 is placed in a groove arranged in the edge in order to seal the filling chamber 54.

A device for attaching the external container 5 is mounted slidingly in a sealed manner through the side wall of the bell 56. In FIG. 14, the attachment device comprises two jaws 60 placed on either side of the second end of the external container 5. The jaws 60 are mounted on rods 61 that can be moved by means of actuators 62. Seals 63 ensure that the rods move in a sealed manner. The jaws 60 are formed in order to clamp the neck 17 of the external container 5 under the rim 18, thereby providing a bearing surface.

As shown in FIG. 13, a gas inlet orifice 65 connected to the filling device is formed in the bush 59 and emerges inside the filling chamber 54.

To allow the appropriate positioning of the container in the filling chamber 54, the bottom carriage is mounted slidingly in the vertical direction Z. The apparatus comprises a guide rod 69 on which the mounting plate 53 is mounted by means of runners 71.

A drive system comprises a rod 73 that can be moved in translation and comprises a top end connected to a drive member 72 and a bottom end connected to the bottom carriage 52. For example, the drive member 72 may be a cylinder, particularly a pneumatic cylinder. As a variant, it is possible to provide for the rod 73 to be a threaded rod whose top end is placed in a nut rotated by a motor. In this manner, a rotation of the nut causes a translation of the rod and a translation of the bottom carriage. The movement of the bottom carriage is limited to a travel determined in particular by a stop member 75 mounted on the foot 50.

The apparatus also comprises a welding device mounted on a top carriage 76 offset in the direction Z relative to the bottom carriage 52. The top carriage 76 is mounted slidingly on the guide rod 69 so as to follow the movements of the bottom carriage 52.

To apply the production method described above, provision is made for the welding device to be able to apply an axial load on the attachment sleeve 22 and generate a friction, particularly by applying ultrasound vibrations, between the attachment sleeve 22 and the external container 5.

The welding device comprises an ultrasound vibration generator 77 and the welding arm 70 which extends vertically along the axis of the external container 5. The welding arm 70 comprises a first end connected to the generator 77 and a second end. The second end extends in the filling chamber 54 through the guide opening and comes into contact with the attachment sleeve 22.

The generator 77 can generate ultrasound vibrations transmitted via the welding arm 70 to the attachment sleeve 22, generating a friction and a heating between the attachment sleeve 22 and the external container 5.

To apply the axial load and allow the lifting of the attachment sleeve 22, provision is made for the attachment sleeve 22 to be able to be attached to the second end of the welding arm 70 and for the top carriage 76 to be able to be moved in the direction Z relative to the bottom carriage 52.

In particular, as shown in FIG. 14, a seat 80 suitable for housing at least a portion of the attachment sleeve 22 is formed on the second end of the welding arm 70. A duct 81 opening into the seat 80 is connected to a suction device, not shown, so as to be able to create the vacuum in the seat 80. In FIG. 14, a vacuum orifice connected to the suction device is formed in a portion of the bush 59 situated above the seal 68. A second seal 82 delimits a vacuum chamber into which a suction orifice 83, communicating with the duct 81, emerges.

In this manner, the sliding of the welding arm 70 achieved jointly with the movement of the top carriage 76 makes it possible, when the suction device is activated, to lift the attachment sleeve 22 relative to the external container 5. The attachment device holding the external container in position, the suction device, the duct and the seat therefore form a system for releasing the mounting opening 16 in order to allow the insertion of gas into the internal volume.

The movement of the top carriage relative to the bottom carriage may be achieved by means of a drive system similar to the drive system of the bottom carriage described above. Therefore, a rod 85 comprising a top end connected to a drive member 86, for example a pneumatic cylinder, and a bottom end connected to the top carriage 76, may be movable in translation. As a variant, the rod 85 may be threaded and the drive member 86 may comprise a nut rotated by a motor.

Such an apparatus may also be used for carrying out the welding of the attachment sleeve 22 to the internal reservoir 3.

The invention claimed is:

1. A method for producing a device for dispensing a fluid product under pressure, comprising:

an internal reservoir with a variable volume comprising a deformable side wall and a dispensing opening, a valve comprising a body, a stem slidingly mounted in the body between a rest position and an actuation position, and an actuation member mounted on the stem, said valve being suitable for dispensing the pressurized fluid product to outside when the stem is in the actuation position, an external container made of thermoplastic polymer, rigid, of cylindrical shape along an axis and comprising a first closed end and a second end having a single mounting opening, an attachment sleeve made of thermoplastic polymer and comprising a single central orifice, said method comprising the following steps:

mounting the body of the valve into the dispensing opening of the internal reservoir, sealingly attaching the attachment sleeve to the internal reservoir, the central orifice of the attachment sleeve being traversed by the stem of the valve, disposing the internal reservoir and the valve inside the external container along the axis through the mounting opening, the actuation member protruding toward the outside relative to the mounting opening, placing the attachment sleeve opposite to and at a distance from the second end of the external container, introducing through the mounting opening a pressurized gas into an internal volume delimited between the internal reservoir and the external container, and subsequently, closing off the mounting opening with the attachment sleeve and welding the attachment sleeve and the external container to one another.

2. The production method according to claim 1, wherein:

before the step of attaching the attachment sleeve to the internal reservoir, the external container whose second end forms a neck which delimits the mounting opening, and the attachment sleeve comprising a side wall suitable for being sleeve-fitted into the neck are produced, the side wall and the neck comprising respectively two radial thickenings comprising respectively two end zones suitable for interfering with one another during the step of closing off the mounting opening and welding the attachment sleeve and the external container, at least one of the end zones having a frustoconical terminal surface flaring outward, during the step of closing off the mounting opening and welding the attachment sleeve and the external container, the side wall is sleeve-fitted into the neck and the end zones are fused together.

3. The production method according to claim 2, wherein:

the neck of the external container is produced with an annular rim which extends radially outward and which has a first contact surface, and the attachment sleeve is produced with an annular collar having a second contact surface suitable for being in contact with the first contact surface, a recess on at least one of the first and second contact surfaces being produced, during the step of closing off the mounting opening and welding the attachment sleeve and the external container, at least a portion of the fused thermoplastic polymer of the end zones is moved into the recess.

4. The production method according to claim 1, wherein, after the disposing step, the attachment sleeve is positioned on the second end of the external container, and during the placing step, the attachment sleeve is lifted.

5. The production method according to claim 4, wherein, to lift the attachment sleeve, the attachment sleeve is sucked into a seat in which the vacuum is generated.

6. The production method according to claim 1, wherein, during the step of attaching the attachment sleeve to the internal reservoir, the internal reservoir and the attachment sleeve are welded to one another.

7. The production method according to claim 6, wherein:

before the step of attaching the attachment sleeve to the internal reservoir, the attachment sleeve comprising an annular base which extends perpendicularly to an axis and which has a first welding surface, and the internal reservoir comprising a ring which extends in a vicinity of the dispensing opening, perpendicularly to an axis, and which has a second welding surface are produced in thermoplastic polymer, at least one of the first and second welding surfaces comprising a protruding annular retaining ring, during the step of attaching the attachment sleeve to the internal reservoir, the base and the ring are positioned coaxially, the retaining ring protruding relative to one of the first and second welding surfaces being in contact with the other welding surface, and the retaining ring and said welding surface are fused.

8. The production method according to claim 1, wherein, during the step of closing off the mounting opening and welding the attachment sleeve and the external container, an axial load is applied and a friction between the attachment sleeve and the external container is generated.

9. The production method according to claim 8, wherein the friction is generated by ultrasound vibrations applied to the attachment sleeve.

10. The production method according to claim 1, also comprising, after the step of closing off the mounting opening and welding the attachment sleeve and the external container, a step of installing the actuation member on the valve.

11. The production method according to claim 1, also comprising, after the step of closing off the mounting opening and welding the attachment sleeve and the external container, a step of filling the internal reservoir with fluid product.

12. An apparatus for implementing the production method according to claim 1, comprising:

a pressurized gas filling device, a filling chamber closed in a sealed manner and connected to the filling device, said chamber being suitable for receiving at least the second end of the external container and the attachment sleeve positioned on said second end, a release system mounted in the filling chamber and suitable for moving the external container and the attachment sleeve relative to one another and releasing the mounting opening, a welding device placed at least partly in the filling chamber and suitable for welding the external container and the attachment sleeve to one another.

13. The apparatus according to claim 12, wherein the welding device is suitable for applying an axial load to the attachment sleeve and generating a friction between the attachment sleeve and the external container.

14. The apparatus according to claim 13, wherein the welding device is suitable for generating the friction by applying ultrasound vibrations to the attachment sleeve.

15. The apparatus according to claim 14, wherein the welding device comprises an ultrasound vibration generator and a welding arm which extends along the axis of the external container, the welding arm comprises a first end connected to the generator and a second end which extends in the filling chamber and which is in contact with the attachment sleeve, the generator and the welding arm being able to be moved in translation along the axis of the external container relative to the filling chamber.

16. The apparatus according to claim 15, wherein the release system comprises a fastening device of the external container, a suction device, a duct connected to the suction device and emerging into a seat formed on the second end of the welding arm and suitable for housing at least a portion of the attachment sleeve.

17. A device for dispensing pressurized fluid product, comprising:

an internal reservoir with a variable volume and suitable for containing a fluid product to be dispensed, said internal reservoir comprising a deformable side wall and a dispensing opening, a valve comprising a body mounted in the dispensing opening, a stem slidingly mounted in the body between a rest position and an actuation position, and an actuation member mounted on the stem, said valve being suitable for dispensing the pressurized fluid product to outside when the stem is in the actuation position, an external container, made of thermoplastic polymer, rigid, of cylindrical shape along an axis and comprising a first closed end and a second end having a single mounting opening, the internal reservoir and the valve being placed inside the external container along the axis, the actuation member protruding toward the outside relative to the mounting opening, the internal reservoir and the external container delimiting between the reservoir and the container an internal volume for containing a pressurized gas, an attachment sleeve made of thermoplastic polymer, sealingly attached to the internal reservoir, said attachment sleeve sealingly closing off the mounting opening and being welded at the second end of the external container, said attachment sleeve comprising a single central orifice traversed by the stem.

18. The dispensing device according to claim 17, wherein the second end of the external container forms a neck which delimits the mounting opening and the attachment sleeve comprises a side wall that is sleeve-fitted into the neck, the side wall and the neck are welded to one another along an axial welding zone.

19. The dispensing device according to claim 18, wherein the neck comprises an annular rim which extends radially outward, the attachment sleeve comprising an annular collar in contact with the rim along a radial contact zone, a recess receiving at least one portion of the thermoplastic polymer of the welding zone being made in said contact zone.

20. The dispensing device according to claim 17, wherein the internal reservoir is at least partly made of thermoplastic polymer, the internal reservoir and the attachment sleeve being welded to one another.

21. The dispensing device according to claim 20, wherein the attachment sleeve comprises an annular base which extends radially inside the external container, the internal reservoir comprising a ring which extends radially in the vicinity of the dispensing opening, the base and the ring being welded to one another along a radial welding zone.

22. The dispensing device according to claim 17, wherein the first end of the external container is of spherical shape, the dispensing device also comprising a plinth which is associated with the external container and which defines a flat bearing surface.

23. The dispensing device according to claim 17, wherein the thermoplastic polymer is chosen from polyethylene terephthalate and polyethylene naphthalate.

24. The dispensing device according to claim 17, wherein the thermoplastic polymer is transparent.

25. The dispensing device according to claim 17, comprising a fluid product placed in the internal reservoir.

* * * * *